US005259225A

United States Patent [19]

Koch

[11] Patent Number: 5,259,225

[45] Date of Patent: Nov. 9, 1993

[54] METHOD AND APPARATUS FOR PRODUCING A STAMPED PRODUCT

[75] Inventor: Eugene P. Koch, Greenville, S.C.

[73] Assignee: Hovis Precision Products Division of Rochez Bros., Inc., Simpsonville, S.C.

[21] Appl. No.: 827,992

[22] Filed: Dec. 3, 1991

[51] Int. Cl.[5] ..... B21D 37/18

[52] U.S. Cl. ..... 72/43; 72/446; 83/169; 83/700

[58] Field of Search ..... 470/26, 40, 57, 87, 470/110; 83/169, 700; 72/41, 43, 446, 447, 440

[56] References Cited

U.S. PATENT DOCUMENTS

| | | | |
|---|---|---|---|
| 3,489,049 | 1/1970 | Krynytzky et al. | 83/700 |
| 4,091,580 | 5/1978 | Oates | 83/169 |
| 4,550,588 | 11/1985 | Abe et al. | 72/447 |
| 4,628,780 | 12/1986 | Hicks | 83/99 |
| 4,662,256 | 5/1987 | Hicks | 83/124 |
| 4,676,090 | 6/1987 | Nishimura et al. | 72/446 |
| 4,790,173 | 12/1988 | Boutcher, Jr. | 72/446 |

*Primary Examiner*—David Jones
*Attorney, Agent, or Firm*—Leatherwood Walker Todd & Mann

[57] ABSTRACT

A press machine having a composite piston assembly, a lubricant oil recovery system, and interchangeable die alignment members. The composite piston assembly includes a primary piston member and a secondary piston member attached thereto for movement with the primary piston member. The secondary piston member includes recesses for receiving a spider and a punch retainer and also has a die retainer attached thereto. The lubricant recovery system collects lubricant which leaks from the press machine during normal operation, filters such lubricant, and returns it to the lubricating system of the press machine for re-use. The interchangeable alignment numbers are of a standardized dimension whereby when received in a receptacle on the frame of the press machine, no machining to the alignment members is required because expendable spacers of a predetermined thickness are used.

20 Claims, 8 Drawing Sheets

METHOD AND APPARATUS FOR PRODUCING A STAMPED PRODUCT

BACKGROUND OF THE INVENTION

This invention relates generally to a press machine, and more particularly to a press machine having a composite piston assembly, an interchangeable alignment system, a lubricant recovery system, a pressurized fluid control system, and a method for aligning the die assemblies of the press.

Generally, a punch press is designed to form stampings from a strip of steel or other suitable material. A punch press, such as that disclosed in U.S. Pat. No. 3,213,729, issued to Richard C. Koch, typically has two die assemblies. The first die assembly, which includes a button die, a punch, and a knockout, is attached to a piston which reciprocates back and forth within a cylinder. The piston is connected to a crankshaft, which is rotated by a motor. The second die assembly includes a stripper assembly having a compound blank and a stripper insert. The second die assembly is substantially fixed to the frame of the press machine.

In the operation of a conventional press machine, a strip of stock to be stamped is inserted between the first and second die assemblies, the die assemblies having been previously axially aligned with respect to one another. As the motor turns the crankshaft, the piston is advanced towards the strip of stock. This causes the first die assembly to receive the compound blank, thereby piercing and punching the strip of stock in the process. At the same time, the punch of the first die assembly enters the compound blank of the second die assembly to blank and pierce the stamping from the strip of stock. In so doing, the button die pushes the stripper assembly inwardly into the second die assembly, compressing springs which press against the stripper assembly.

As the piston of the press is retracted, the springs force the stripper assembly towards the strip of stock to strip the stock from the compound blank. A slug of the stock material is also cleared from the inside of the compound blank.

As the piston retracts fully, the knockout of the first die assembly engages a stop bar, and in so doing, is advanced to strip away the stamped part from the button die and off of the punch of the first assembly.

A problem with press machines arises in aligning the first and second die assemblies with respect to one another. Axial alignment of the two die assemblies is essential for proper stamping of a part. Generally, alignment adjustments are made with the second die assembly, since the first die assembly is attached to the piston, thereby causing alignment adjustment of the first die assembly to be impractical. An important consideration is the elevation of the second die assembly with respect to the elevation of the first die assembly. In a press machine such as the 1½ inch diameter, four ton capacity, horizontal press manufactured by Hovis Precision Products, Division of Rochez Bros., Inc., of Simpsonville, S.C., the second die assembly is carried in alignment, or receiver, blocks. The receiver blocks are held in a receptacle in the frame of the press machine.

In order to achieve proper elevational alignment of the second die assembly, the base of the receiver block must be precision-ground, which is a time-consuming and expensive process. After the receiving block has been precision-ground, it may be used good for that particular machine only and generally would not be usable with a subsequent machine. Should the receiving block be ground down too far, the receiving block would not be usable, and the cost for such a receiving block and the machining done on the block to that point would be lost.

Another problem arises in increasing the tonnage capacity of a press. In so doing, the size and mass of the piston for the press must be increased accordingly. However, the manufacture of a piston having the necessary size and mass for use in a press of, for example, a 20 ton capacity, is impractical and unduly expensive.

Turning from alignment of the die assemblies of a press to the ejection of the stamped parts and resulting slugs from the press, U.S. Pat. No. 4,268,780, issued to Charles D. Hicks, discloses an air ejector system for shedding and ejecting a slug from a central punch of a punch machine. The air is controlled by a spring-loaded, cam-actuated, three-way valve which opens or closes the air flow from an air supply line responsive to the position of a moving die assembly. While such an air ejection system is effective, the timing of the air delivery to the die assembly is not readily varied.

Inherent to the operation of many metal-working machines, including press machines, is the fact that lubricating fluid delivered to the machines during their operation tends to leak from those lubricated portions of the machines. Such leaking lubricating fluid tends to collect on the exterior surfaces of the machine, causing dust and dirt to adhere to the lubricant on the machine's surfaces, thereby causing a dirty and grimy coating to form on the machine's surface. Not only is such a coating unsightly, but it could potentially impede the manufacturing cleanliness necessary to produce precision parts. Moreover, the leaking lubricant tends to collect on the shop floor around the machines, thereby potentially interfering with movement about the machine by workers and equipment. Finally, because the leaking fluid is typically not recovered but instead is wasted and not reused, new lubricant must be provided to the machines to replace that which is lost through leakage, thereby requiring further use of our limited natural resources for providing lubricating fluid.

Other patented components for press machines are disclosed in U.S. Pat. No. 2,699,830, issued to Hugh M. Hodge, which discloses readily interchangeable punch and die equipment, and U.S. Pat. No. 4,662,256, issued to Charles D. Hicks, which discloses an improved die set where knockout pins of the die set may be replaced without requiring realignment of the die and die retaining components.

SUMMARY OF THE INVENTION

Accordingly, it is an object of the present invention to provide a method for aligning the die assemblies of a press machine.

Another object of the present invention is to provide a means for facilitating the alignment of the die assemblies of a press machine.

Yet another object of the present invention is to provide a composite piston structure for a press machine.

Another object of the present invention is to provide means for aligning the die assemblies of a press machine which can be interchanged into another press machine.

Still another object of the present invention is to provide a means for selectively controlling pressurized air delivered to a die assembly of a press machine.

Still further, another object of the present invention is to provide a means for recovering lubricating fluid which has leaked from a machine and resupplying the fluid to the machine.

Generally, the present invention includes a press machine comprising a frame and a motor attached to a frame. A crankshaft is rotatably carried by the frame and connected to the motor for rotation by the motor. A cylinder is carried by the frame, and the cylinder defines a longitudinally-extending bore therein. Piston means are carried for movement within the bore of the cylinder, and the piston means are connected to the crankshaft for rectilinear movement within the bore of the cylinder upon rotation of the crankshaft.

A first die assembly is connected to the piston means for movement with the piston means. A second die assembly adjacent to the first die assembly is connected to the frame. Stock supply means are connected to the frame for supplying stock to the first and second die assemblies for stamping therebetween.

The frame defines a receiving member receptacle having a first reference surface. A receiving member is provided having a second reference surface. The receiving member is carried in the receptacle and defines at least one recess for receiving the second die assembly therein, the recess being a first pre-determined distance from the second reference surface. At least one spacer of a predetermined thickness is interposed in the receptacle between the first and second reference surfaces causing the second die assembly carried in the receiving member to be in a pre-determined position with respect to the first die assembly.

The piston means of the present invention include a primary piston member having a first end and a second end, the first end being connected to the crankshaft of the press machine, and the second end defining a first cooperating interface. A secondary piston member has a forward end and a rearward end, the rearward end defining a second cooperating interface for interconnecting with the first cooperating interface of the primary piston member, thereby substantially fixing the secondary piston member for movement with the primary piston member. The forward end of the secondary piston member defines a spider recess for receiving a spider therein and a punch recess adjacent to the spider recess for receiving a punch therein.

A control system for controlling an air system on a press machine is also provided by the present invention, such air system having an air supply and being connected to a die set of the press machine. The control system comprises at least one valve associated with the press machine and the die set being in fluid communication with the air supply. The valve has at least one moveable actuator for actuating the valve upon movement of the actuator to allow air to pass from the air supply, through the valve, into the die set. A rotatable cam, defining a cam profile surface thereon is provided, as is a moveable cam follower connected to the actuator for movement of the actuator upon movement of the cam follower. The cam follower contacts the cam profile surface during rotation of the cam such that the cam follower displaces the actuator in response to the cam profile surface, thereby moving the cam follower and the actuator to actuate the valve for supplying air from the air supply to the die set.

Further, the present invention provides a lubricant collection system for a machine having a lubrication system where leakage of lubricant occurs about lubricated portions of the machine. The lubricant collection system comprises an outwardly extending collection surface projecting outwardly from the lubricated portions of the machine. The outwardly extending collection surface defines at least one collection channel therein, the collection surface being in fluid communication with the collection channel. The collection channel defines a drain, such that upon lubricant leaking from the lubricated portions of the machine, the leaking lubricant collects on the collection surface and in the collection channel and flows to the drain. A filter means in fluid communication with the drain is provided for receiving lubricant therefrom and for filtering lubricant received from the drain. Pumping means in fluid communication with both the filter means and the lubricating system of the machine pumps lubricant filtered by the filter means to the lubricating system of the machine for reuse by the lubricating system.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, and which.

DESCRIPTION OF THE PREFERRED EMBODIMENT

Figure 1:
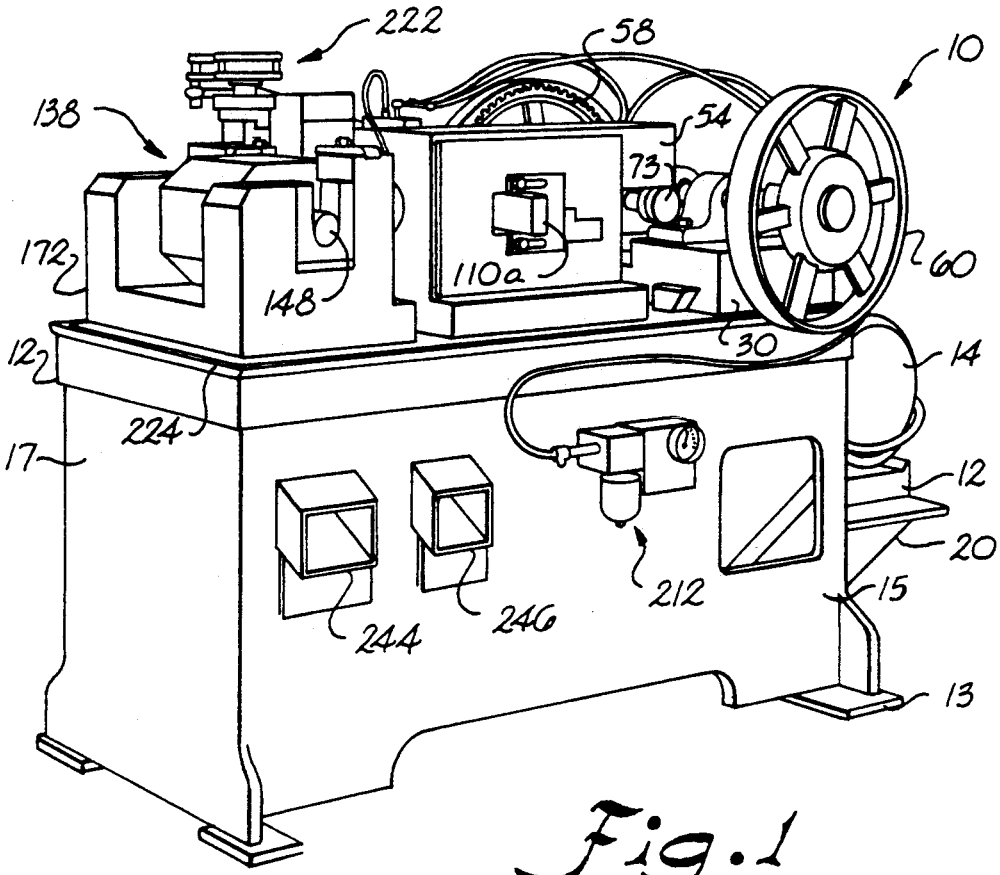
FIG. 1 is the prospective view of a press machine constructed in accordance with the present invention.
Figure 2:
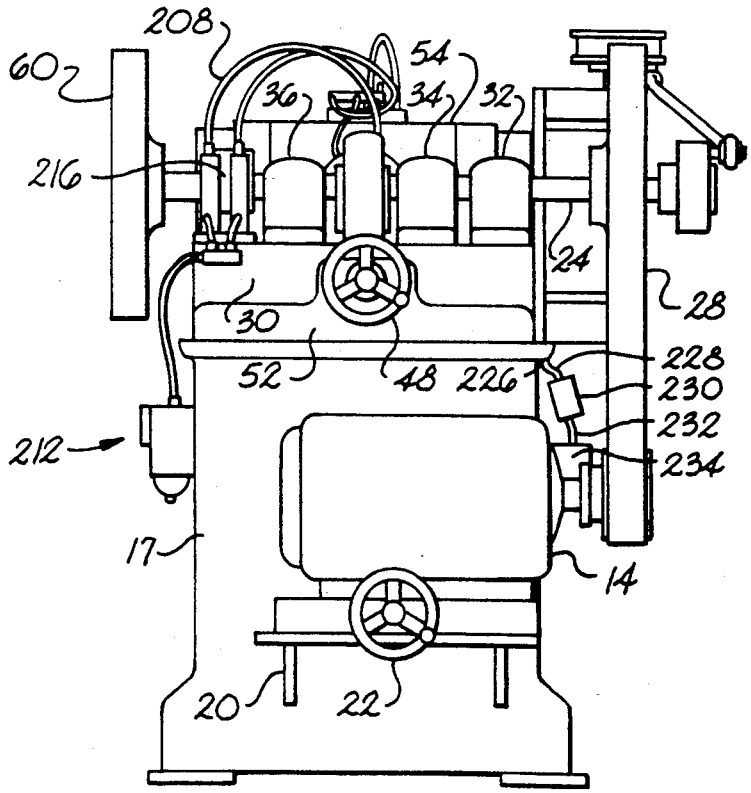
FIG. 2 is an end elevational view of a press machine constructed in accordance with the present invention.

Referring to the drawings in detail, wherein like reference characters represent like elements and/or features throughout the various views, the press machine of the present invention is designated generally in FIGS. 1 and 2 by the reference character 10.

Press machine 10 includes a frame, generally 12, resting on pads 13. Covers 15, 17 extend downwardly about the sides and ends, respectively, of frame 12. Motor 14 is attached to frame 12 and rests upon motor support 18. Motor support 18 is connected to motor bracket 20 through a hand wheel and screw mechanism 22 which allows motor support 18 to be selectively moved with respect to motor bracket 20 in a conventional manner.

Figure 12:
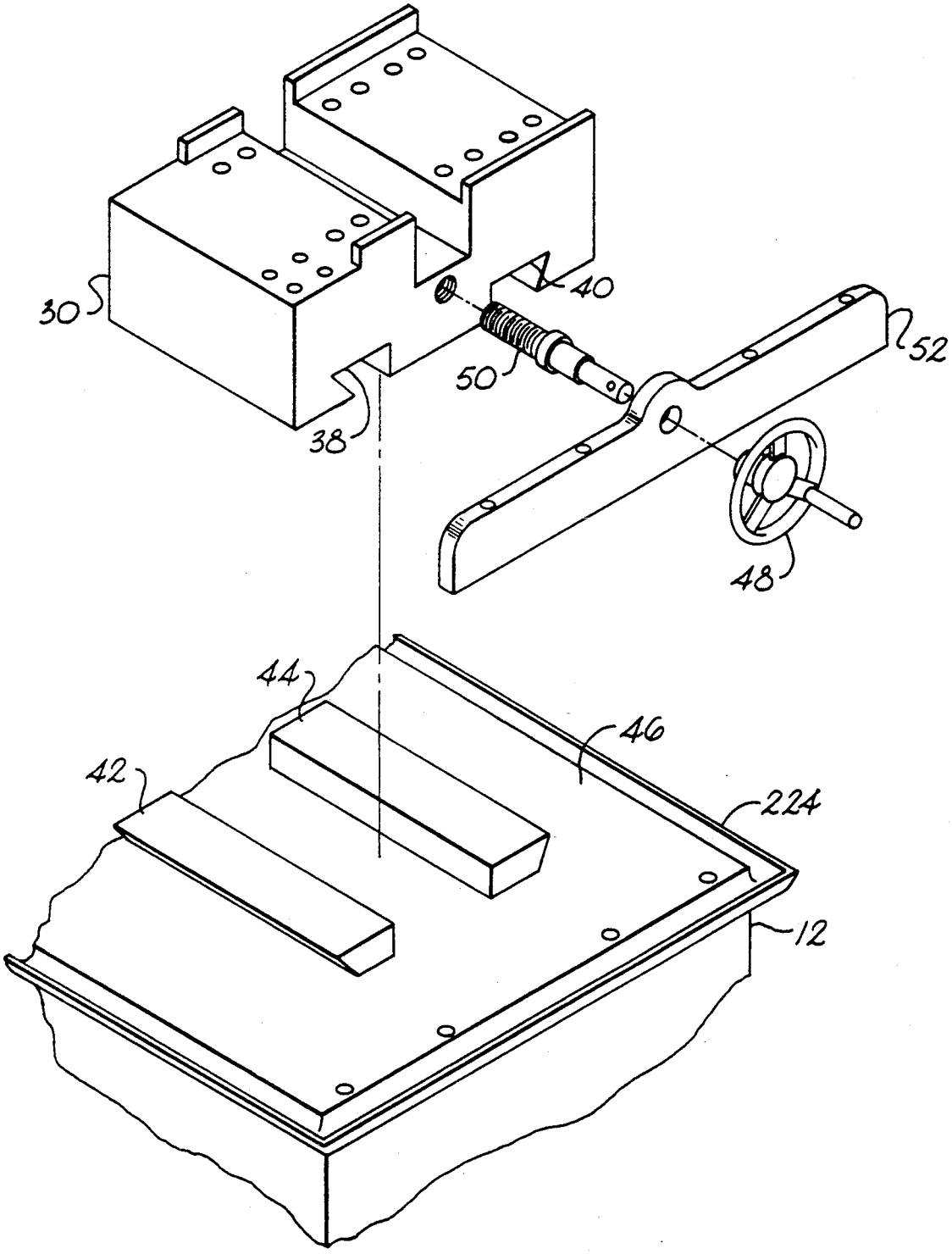
FIG. 12 is a partial exploded view of a lubricant recovery system constructed in accordance with the present invention.

Motor 14 is connected to crank shaft 24 by a toothed belt 28. Crankshaft 24 is connected to a carriage 30 by pillow block bearings 32, 34, and 36 for rotation relative to carriage 30. As shown in FIG. 12, carriage 30 includes grooves 38, 40 for receiving rails 42, 44, respectively, mounted on a lubricant collection surface 46. A hand wheel 48 and screw 50 cooperate with standard 52, which is attached to lubricant collection surface 46, to allow the position of carriage 30, and crankshaft 24 carried thereon, to be varied with respect to standard 52 and cylinder housing 54, which is also attached to lubricant collection surface 46.

Figure 7:
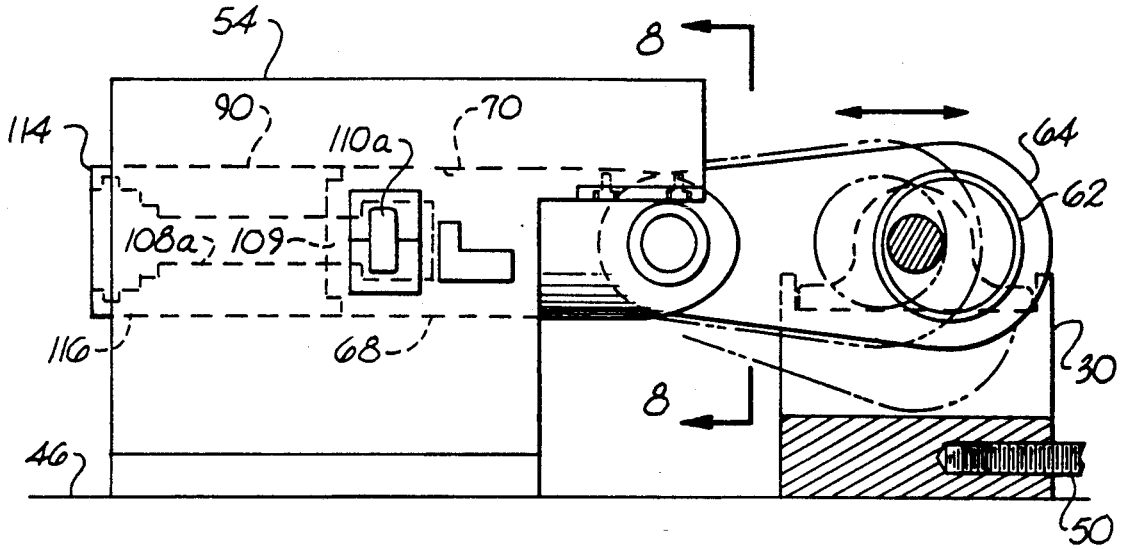
FIG. 7 is a partial side elevational view of a press machine constructed in accordance with the present invention.

Crankshaft 24 includes toothed wheel 58 for receiving toothed belt 28 and for allowing rotation of crankshaft 24 by motor 14 via toothed belt 28. On the opposite end of crankshaft 24 from toothed wheel 58 is a flywheel 60. Crankshaft 24 includes an eccentric cam 62, as best shown in FIG. 7, to which one end of a connecting rod 64 is attached for movement relative to cam 62. The other end of connecting rod 64 is attached to a primary piston member 68, which is of a substantially cylindrical shape, and which is carried in a cylindrical bore, or cylinder, 70 of cylinder housing 54. Connecting rod 64 is movably connected to primary piston member 68 by means of a wrist pin connection.

Figure 8:
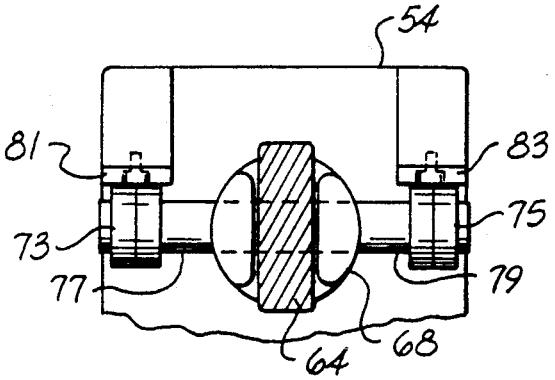
FIG. 8 is a partial sectional view along line 8—8 of FIG. 7.

As shown in FIG. 8, rollers 73, 75 are connected to primary piston member 68 by shafts 77, 79. Rollers 73, 75 roll against the surfaces of shims 81, 83 attached by bolts to cylinder housing 54. Shims 81, 83 are each machined to a thickness such that primary piston member 68 is properly aligned radially about its axis upon contact of rollers 73, 75 with the surfaces of shims 81, 83. Once primary piston member 68 is properly aligned about its axis, it generally does not require subsequent realignment.

Upon rotation of crankshaft 24, and rotation of cam 62, which is fixed to crank shaft 24, connecting rod 64 causes primary piston member 68 to move back and forth, in rectilinear motion, within bore 70 of cylinder housing 54.

On the end 74 of primary piston member 68 opposite to the end of 78 where connecting rod 64 is connected, a cooperating interface, generally 80, is provided on the face 82 of primary piston 68. The cooperating interface 80 includes a raised, substantially cylindrical portion 84 extending outwardly from face 82 of primary piston member 68. Cooperating interface 80 cooperates with an adjacent cooperating interface, generally 88, on a retainer adaptor spacer, or secondary piston member, 90.

Secondary piston member 90 is of a substantially cylindrical overall shape and includes at cooperating interface 88 a substantially cylindrical recessed portion 92 for receiving the cylindrical projection 84 of primary piston member 68 in a cooperating manner such that face 82 of primary piston member 68 contacts the circular ridge surface 94 of the rearward end 98 of secondary piston member 90.

A longitudinally extending groove 100 is provided in the surface 102 of secondary piston member 90 for cooperating with a projection 104 provided on the wall 108 of cylindrical bore 70. The interaction between projection 104 and groove 100 of secondary piston member 90 substantially prevents rotation of secondary piston member 90 with respect to bore 70.

The die assemblies and air ejection system are not disclosed herein in detail since such assemblies and air ejection system are known. As an example, U.S. Pat. No. 4,628,780, issued to Charles D. Hicks on Dec. 16, 1986, discloses die assemblies and an air ejector system which are suitable for use in the preferred embodiment of the present invention. Accordingly, U.S. Pat. No. 4,628,780 is incorporated herein by reference thereto.

The forward end 110 of secondary piston member 90 defines a spider recess 112 for receiving a spider (not shown) of conventional design. Adjacent to spider recess 112 is a punch retainer recess 113 for receiving a punch retainer (not shown).

Figures 10, 11:
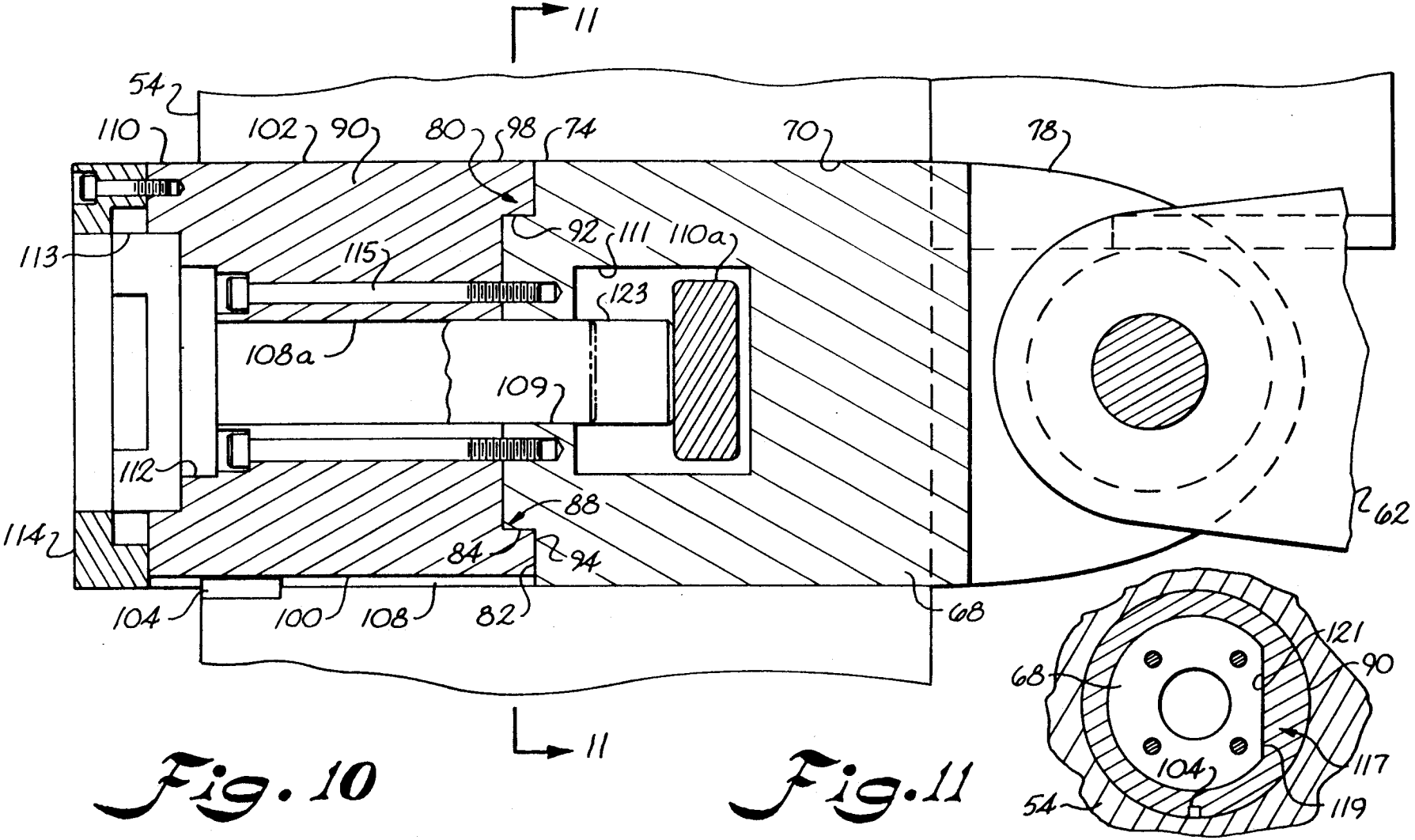
FIG. 10 is a partial sectional view of a piston assembly constructed in accordance with the present invention.
FIG. 11 is a partial sectional view along line 11—11 of FIG. 10.

The secondary piston member 90 is fixedly attached to primary piston member 68 by bolts 115 and key connection, generally 117, shown in FIG. 11, which includes a substantially flat scalloped surface 119 on cylindrical portion 84 and a flat receiving surface 121 inside recessed portion 92 for cooperating with scalloped surface 119, to prevent rotation of piston members 68, 90 with respect to one another. Of course, any other suitable fastening means could be used to connect together piston members 68,90. Both primary piston member 68 and secondary piston member 90, and cylinder block, or housing, 54 are preferably constructed of steel, although any other suitable material could be used.

Spider shank passages 108*a*, 109 extend longitudinally within secondary piston member 90 and primary piston member 68, respectively, for allowing the spider shank 123 (partially shown) of a knock-out assembly to contact with stop bar 110*a*, which is received in stop bar slot 111 of primary piston member 68. The operation of a spider shank against a stop such as stop bar 110*a* is disclosed in U.S. Pat. No. 4,628,780, incorporated hereinabove by reference.

Attached to forward end 116 of secondary piston member 90 is a die retainer 114 which is attached to secondary piston member 90 by bolts and a key connection similar to the key connection 117 between piston members 68, 90.

Figure 13:
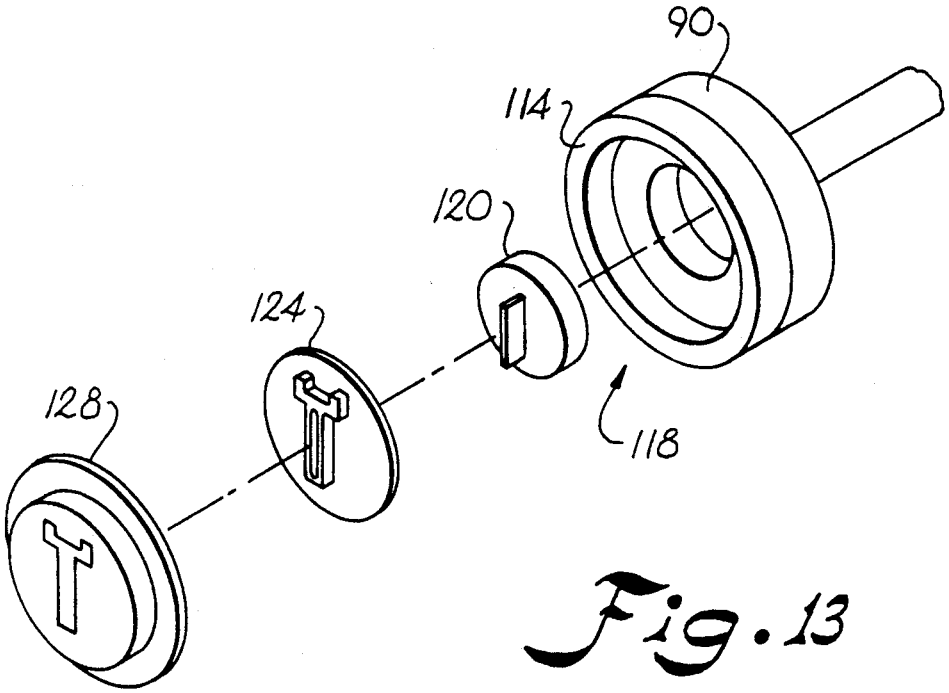
FIG. 13 is an exploded view of die assembly members of a die assembly constructed in accordance with the present invention.

Referring to FIGS. 10 and 13, a first die assembly, generally 118, includes secondary piston member 90 having a punch 120 held by punch retainer (not shown) within punch retainer recess 113 and a knockout 124 held between punch 120 and die button 128, which is retained by die retainer 114.

Figure 5:
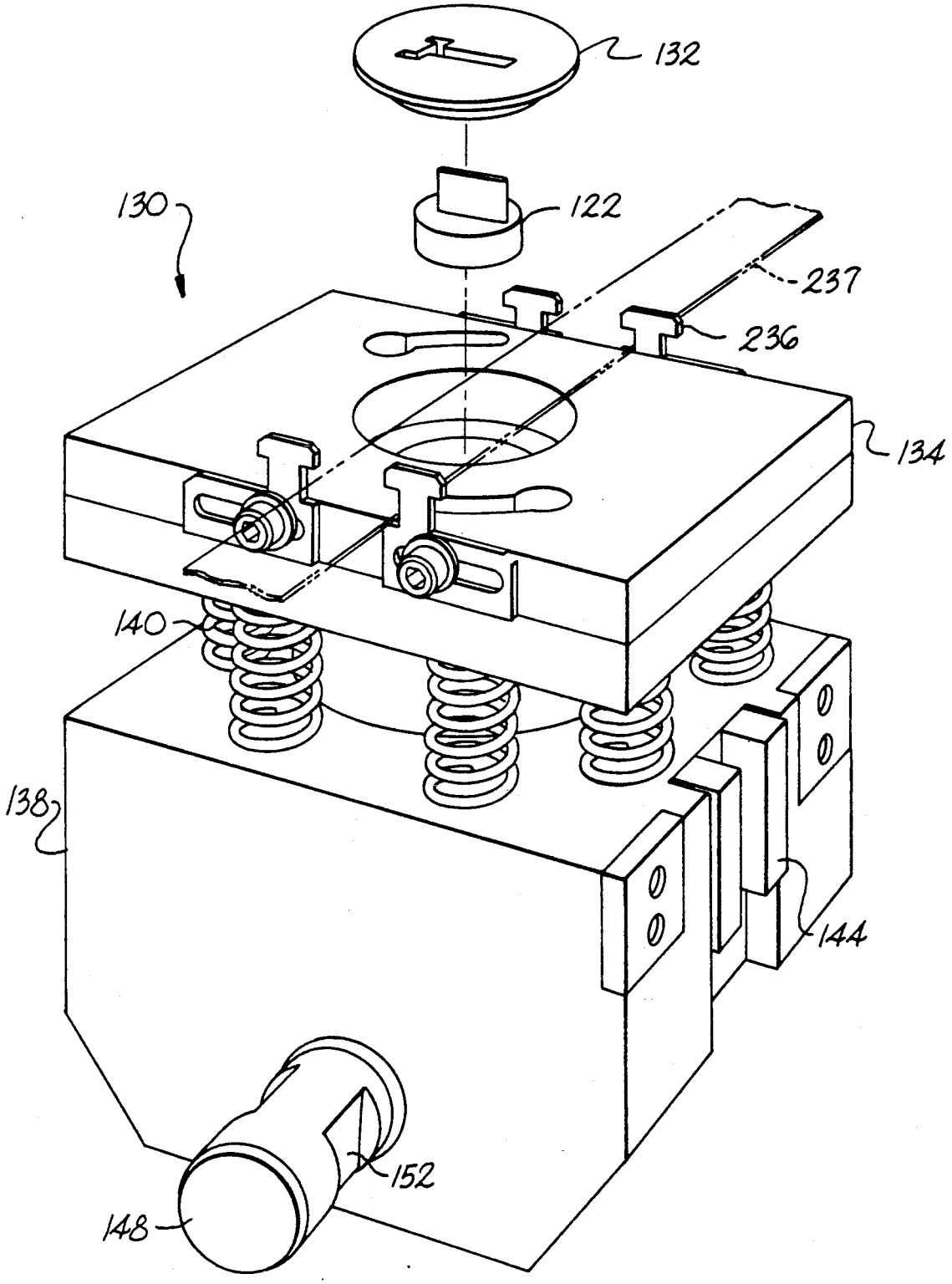
FIG. 5 is a perspective view of a die assembly constructed in accordance with the present invention.

Referring to FIG. 5, the second die assembly, designated generally as 130, includes a stripper block 134 having stripper insert 132 and a compound blank 122 therein. For a more detailed discussion of such a second die assembly, refer to U.S. Pat. No. 4,628,780, which is incorporated hereinabove by reference thereto.

Punch 120, knockout 124, die button 128, compound blank 122, and stripper insert 132 are shown, for illustrative purposes only, having configurations and profiles for producing a stamped part of a particular design. It is to be understood that any number of stamped part designs could be provided merely by changing the configurations and profiles of the punch, knockout, die button, stripper, compound blank, etc.

Figure 6:
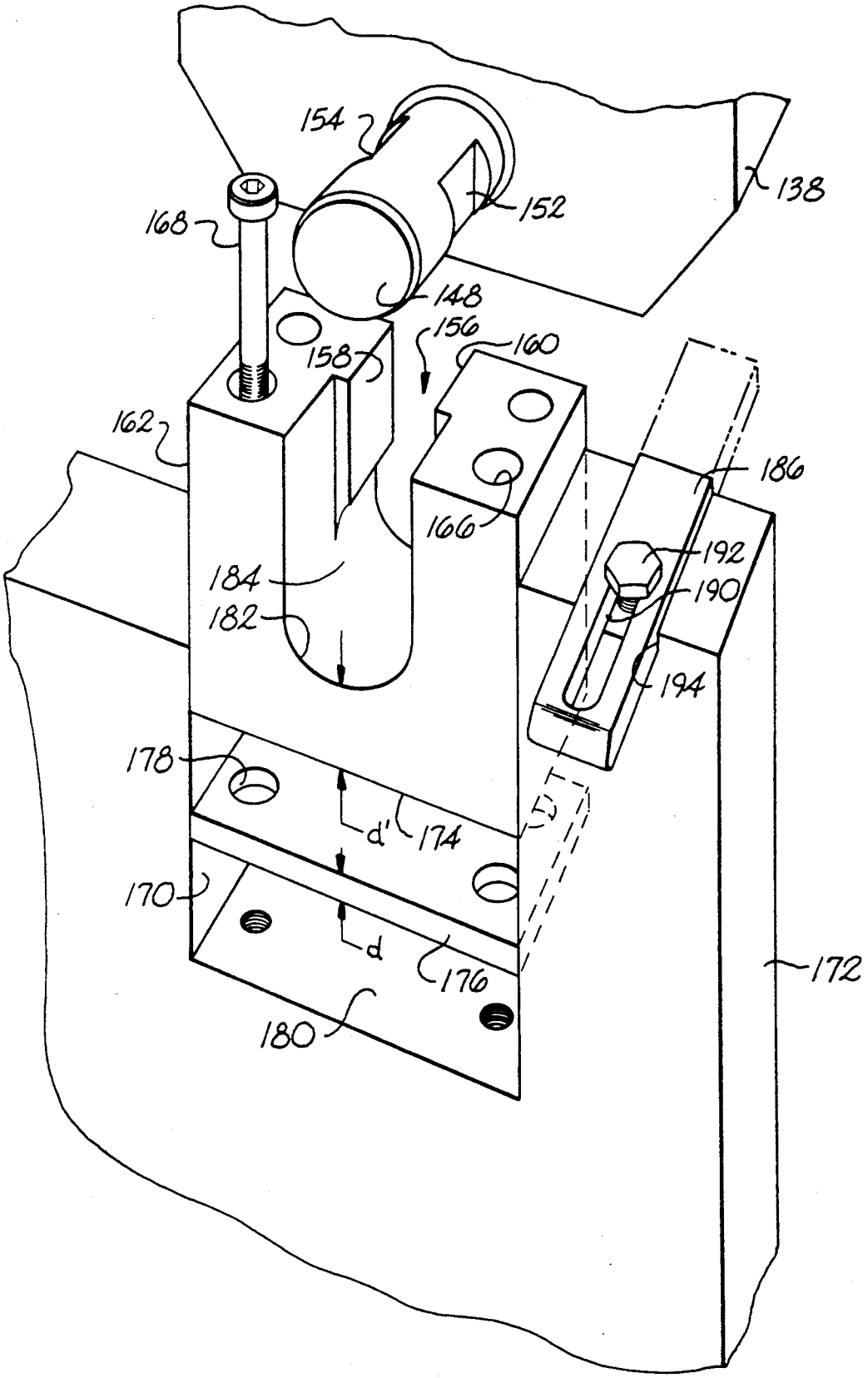
FIG. 6 is a partial perspective view of a receiving member and spacer constructed in accordance with the present invention;.

Stripper block 134 is carried by a rear support member 138. Stripper block 134 is biased away from rear support 138 by springs 140. On a forward face of second die assembly 130 are alignment blocks 144 which cooperate with projecting members 145 on collection surface 46 for maintaining alignment of second die assembly 130 with first die assembly 118 about a horizontal plane. Projecting transversely outward from rear support member 138 are stub shafts 148, 150. Stub shafts 148, 150 are substantially cylindrical in shape but each include recesses 152, 154 for receipt by a passage 156 defined by substantially parallel surfaces 158, 160 of alignment, or receiving, members 162, 164, as best shown in FIG. 6.

Alignment members 162, 164 are substantially mirror images of one another. Each alignment member includes holes 166 for receipt of bolts 168 (only one shown for purposes of clarity) for attachment of the alignment member within a receptacle 170 of die assembly support 172.

Interposed between reference, or base, surface 174 of an alignment member 162, 164 is a shim, or spacer, 176. Spacer 176 is substantially rectangular in cross section and shape and includes holes 178 for receipt of bolts 168 therethrough. Another reference, or support, surface 180 is provided in the lower portion of receptacle 170 of die assembly support 172. Spacer 176 includes opposing faces 177, 179 which extend substantially parallel to one another. Spacer 176 is of predetermined thickness d such that when interposed between base surface 174 and support surface 180, the base 182 of shaft slot 184 is raised a predetermined distance d above support surface 180, with the distance between base surface 174 and base 182 of shaft slot 184 being a predetermined distance d'. Accordingly, when shaft slots 184 of each alignment member 162, 164 receives stub shafts 148, 150 of rear support member 138, the second die assembly 130 is accordingly elevated by an amount equal to the predetermined thickness d of spacer 176.

Upon insertion of stub shafts 148, 150 into shaft slots 184 of alignment members 162, 164, such that recesses 152, 154 of stub shafts 148, 150 cooperate with surfaces 158, 160 to pass through passages 156 of alignment members 162, 164, and upon stub shafts 148, 150 contacting base 182 of shaft slot 184 of each alignment member 162, 164, second die assembly 130 can be rotated from a substantially vertical configuration as shown in FIG. 5 to a substantially horizontal position as shown in FIG. 1. Once in the horizontal position, slide bars 186, 188 are moved inwardly towards one another to extend outwardly from opposite sides of die assembly support 172 to extend over rear support member 138 to hold second die assembly 130 in a horizontal position. Each slide bar 186, 188 includes a slot 190 which cooperates with a bolt 192 and are carried in a channel 194 for movement therein.

Figure 9:
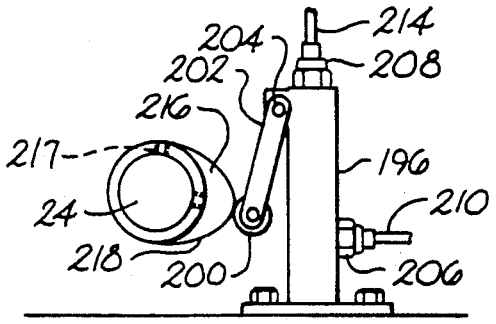
FIG. 9 is a partial side elevational view of a cam and cam follower constructed in accordance with the present invention.

The present invention includes an air ejector system such as disclosed in U.S. Pat. No. 4,628,780 and incorporated by reference hereinabove, wherein pressurized air is delivered to the first die assembly 118 through the punch 120 for ejecting a slug therefrom. There is also air introduced through knockout 124 for ejecting a stamped product therefrom. In an improvement to the air ejector system as disclosed in U.S. Pat. No. 4,628,780, air delivered to first die assembly 118 is controlled by valves 196, 198. Each valve 196, 198 includes a roller cam follower 200, as shown in FIG. 9, attached to a pivotable actuating arm 202. Upon pivoting of actuating arm 202 about pivot 204, the valve is selectively actuated to allow air to pass therethrough. Pivoting of actuating arm 202 could simply open the valve completely and close the valve completely, or, depending on the position of the actuating arm, could modulate the valve, opening the valve in varying degrees between a fully closed state and a fully open state, thereby varying the amount of air supply from the valve.

Each valve 196, 198 includes an inlet port 206 and an outlet port 208. The inlet port receives air through a conduit 210 from an air supply of conventional design, generally 212, of conventional design. Conduit 214 is connected to outlet port 208 and delivers air to first die assembly 118.

A cam 216 is demountably attached to crankshaft 24 by setscrews 217. Cam 216 defines a cam profile surface 218 thereon for contacting cam follower 200 upon rotation of crankshaft 24. As cam 216 rotates, cam follower 200 follows cam profile surface 218, causing actuating arm 202 to pivot about pivot 204, thereby actuating the valve upon a predetermined displacement of actuating arm by cam profile surface 218.

Cam profile surface 218 can be configured to provide optimum timing of air supply to first die assembly 118. Cam profile surface 218 can be changed by replacement of cam 216 or by modifying cam profile surface 218 directly to selectively vary air delivery to first die assembly 118, depending on the needs of the particular operation. Cam 217 acts substantially the same as cam 216 to selectively actuate valve 198. For example, valve 196 can be used to selectively supply air to punch 120 for shedding and ejecting a slug therefrom. Valve 198 can be used to selectively provide air to knockout 124 for providing optimum shedding and ejection of the stamped product.

Figure 3:
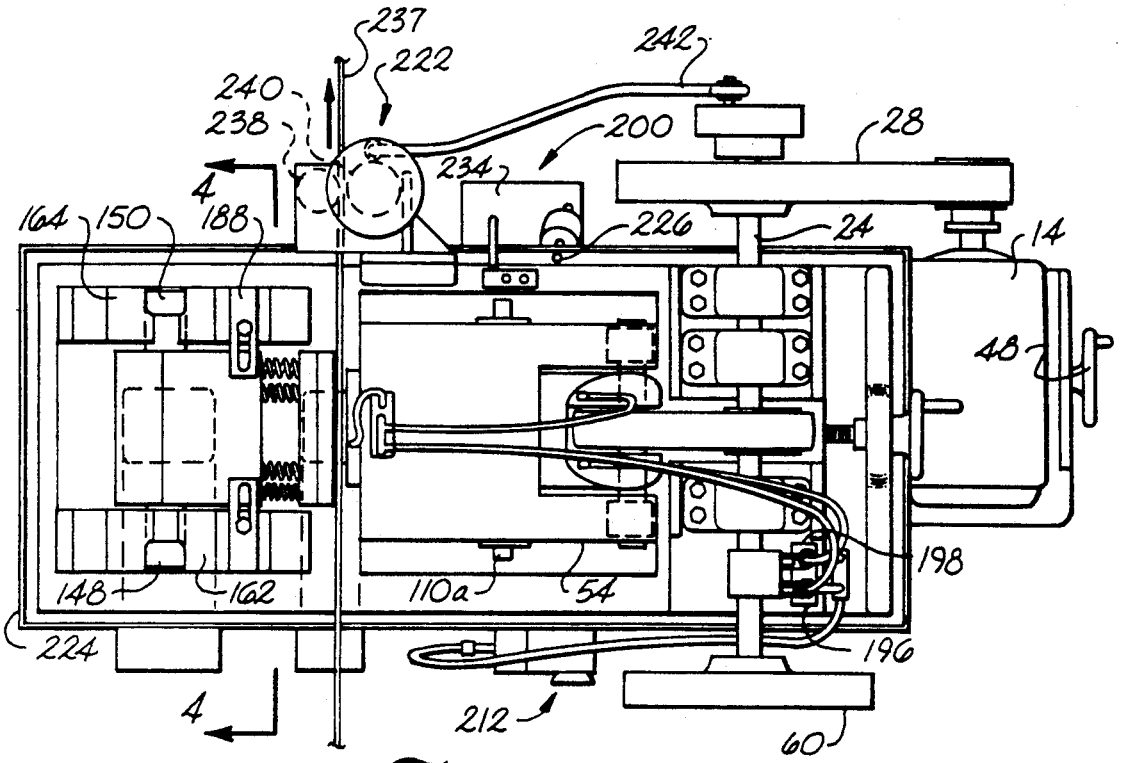
FIG. 3 is a plan view of a press machine constructed in accordance with the present invention.

Lubricating system, generally 220, shown in FIG. 3, is of conventional design and provides the cylinder, crankshaft, piston, feed roller system, generally 222, and the connecting rod with lubricating fluid, or lubricant, during operation of press machine 10. However, during operation, lubricant may leak from the aforementioned lubricated elements, namely, piston members 68, 90, connecting rod 64, bore 70, feed roller system 222, and crankshaft 24. Lubricant collection surface 46 extends outwardly above frame 12 and acts to collect such leaking lubricant. Lubricant collection surface 46 can be horizontal or inclined towards a lubricant collection channel 224 which extends about the periphery of lubricant collection surface 46. Lubricant collection channel 224 can be substantially horizontal or can be inclined such that lubricant collected therein flows to a drain 226. In other words, lubricant collected on lubricant collection surface 46 flows to lubricant collection channel 224 and then onward to drain 226. Conduit 228 connects drain 226 to a filter 230 which filters the collected lubricant of debris. The filtered lubricant then flows through conduit 232 to a pump (not shown) of conventional design. The pump then pumps the recovered and filtered lubricant back into lubricating system 220. Lubricant collection surface 46 and lubricant collection channel 224 could be constructed of a variety of materials and could be added to an existing machine or integrated into the design of a machine being constructed.

Feed roller system 222 is of conventional design, such as one manufactured by Cooper-Weymoth, Peterson, of Clinton, Me., and includes two vertically disposed rollers 238, 240 which pull a strip of stock material 237 therebetween, also pulling the strip of stock material through guides 236 between the die assemblies 118, 130 wherein a stamped part is produced from the stock material 237. The scrap stock material, of course, is pulled from between the die assemblies 118, 130 by feed roller system 222. The feed roller system is powered by linkage arm 242 which is connected to crankshaft 24 for movement by crankshaft 24.

A method is provided by the present invention for aligning die assemblies 118, 130 with respect to one another. Alignment members 162, 164 are of predetermined dimensions for ease of manufacture. In other words, the dimensions of a particular alignment block would be the same as, and interchangeable with, each such alignment block in successive press machines. The alignment block is not specifically formed or finished for a particular press machine 10. For example, the distance d' between base surface 174 and the base 182 of a shaft slot 184 in an alignment block or member 162, 164 is a constant dimension among such alignment members.

In order to align the elevations of a first die assembly 118 and a second die assembly 130, the alignment elevation of first die assembly 118, i.e., the elevation to which second die assembly 130 must be maintained for elevational alignment with first die assembly 118, must first be determined. After this is done, the height by which second die assembly must be raised to be in elevational alignment with first die assembly 118 is then determined. Because alignment members 162, 164 do not need to be specially milled or ground for a particular application but are already of known dimensions, any added elevation needed in order for the second die assembly 130 to be in elevational alignment with first die assembly 118 is made up by inserting one or more expendable spacers 176, which can already have a predetermined thickness, or which can be easily finished to the desired thickness, between base surface 174 and surface 180. Upon insertion of one or more spacers 176 between base surface 174 of an alignment member and support surface 180 of a die assembly support 172, second die assembly 130 is elevationally aligned with first die assembly 118. Lateral alignment of die assemblies 118, 130 with respect to one another can be accomplished by conventional means.

Figure 4:
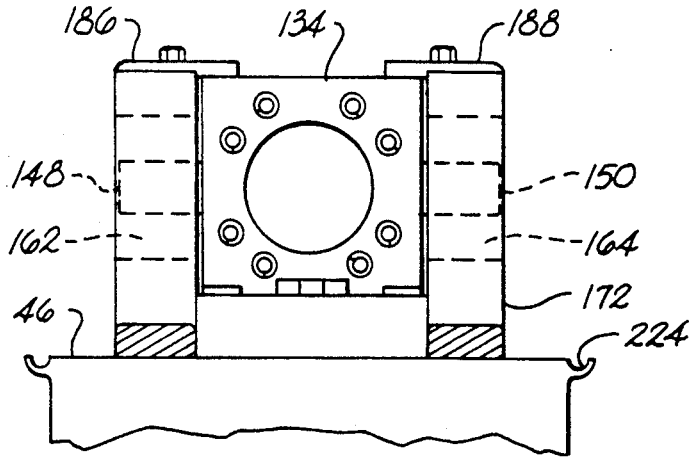
FIG. 4 is a partial sectional view along line 4—4 of FIG. 3.

The alignment member, which has a predetermined distance d' between the base surface 174 thereof and the base 182 of shaft slot 184, is placed in a receptacle 170 of die assembly support 172 on top of the spacer or spacers 176. Bolts 168 are then inserted through holes 166 of the alignment member and through holes 178 of the spacer or spacers 176 for fixedly securing the alignment member within receptacle 170. Second die assembly 130 is then lowered while in a vertical configuration such that recesses 152, 154 of stub shafts 148, 150 cooperate with the surfaces 158, 160 of alignment members 162, 164 and pass through passages 156 and downward until stub shafts 148, 150 contact the base 152 of each shaft slot 184. Second die assembly 130 is then rotated to a substantially horizontal position, as shown in FIG. 4, wherein alignment blocks 144 on the forward face 142 of rear support member 138 cooperate with at least one projection 145 on lubricating collection surface 46 to further fix lateral movement of second die assembly 130 with respect both lubricant collection surface 46 and accordingly, first die assembly 118. Slide bars 186,188 are then moved to a position extending over second die assembly 130 to further prevent second die assembly 130 from moving upwards from a horizontal position.

In operation, after alignment of die assemblies 118, 130 has been accomplished and second die assembly 130 is locked down in a substantially horizontal configuration, a strip of stock material is inserted between die assemblies 118, 130 for receipt by feed roller system 222, which is powered by crank shaft 24 acting through linkage arm 242. Die assemblies 118, 130 then operate to stamp parts from the strip of stock material, with slugs from the parts being delivered to slug chute 244 and the stamped parts being delivered outwardly through stamped part chute 246. The operation of die assemblies 118, 130 and the air system 212 are more fully disclosed in U.S. Pat. No. 4,628,780, incorporated hereinabove by reference thereto.

Crank shaft 24 rotates cam 62 and cams 216, 217 during operation of motor 14. The rotation of crank shaft 24 causes connecting rod 64 to be moved back and forth due to its connection to cam 62. The movement of connecting rod 64 causes primary piston member 68 and secondary piston member 90, which is fixedly attached to primary piston number 68, to actuate first die assembly 118 for stamping products, in cooperation with second die assembly 130.

As crank shaft 24 rotates, cam followers 200 follow cam profile surfaces 218 of cams 216, 217 to selectively actuate valves 196, 198 dependent on the displacement of cam followers 200 by cam profile surfaces 218. Compressed air is delivered from valves 196, 198 to punch 120 and knockout 124, respectively, of first die assembly 118.

While preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art without departing from the spirit or scope of the following claims.

I claim:

1. A lubricant collection system for a machine having a lubrication system where leakage of lubricant occurs about lubricated portions of the machine and drains downwardly, said lubricant collection system comprising:

an outwardly extending collection surface projecting outwardly from and below said lubricated portions of said machine for receiving leaking lubricant from the lubricated portions of said machine, said outwardly extending collection surface defining a peripheral portion about the extremities of said outwardly extending collection surface;

said outwardly extending collection surface defining at least one collection channel in said peripheral portion for receiving leaking lubricant, said collection channel being at a lower elevation than said outwardly extending collection surface, said outwardly extending collection surface being in fluid communication with said collection channel;

said collection channel defining a drain;

said collection channel being inclined towards said drain, such that upon lubricant leaking from said lubricated portions of the machine, the leaking lubricant collects on said outwardly extending collection surface, flows downwardly into said collection channel and subsequently flows to said drain;

a filter means in fluid communication with said drain for receiving lubricant therefrom and for filtering lubricant received from said drain; and pumping means in fluid communication with both said filter means and the lubricating system of the machine for pumping lubricant collected by said collection channel and filtered by said filter means to the lubricating system of the machine for reuse by the lubricating system.

2. The lubricant collection system as defined in claim 1, wherein said outwardly extending collection surface is inclined towards said collection channel for allowing lubricant drainage from said collection surface to said collection channel.

3. A press machine, comprising:

a frame;

a motor attached to said frame;

a crankshaft rotatably carried by said frame and connected to said motor for rotation by said motor;

a cylinder carried by said frame, said cylinder defining a longitudinally extending bore therein;

piston means carried for movement within said bore of said cylinder, said piston means being connected to said crankshaft for rectilinear movement within said bore of said cylinder upon rotation of said crankshaft;

a first die assembly connected to said piston means for movement with said piston means;

a second die assembly adjacent to said first die assembly and connected to said frame;

stock, supply means associated with said frame for supplying stock to said first and second die assemblies for stamping of the stock therebetween;

said frame defining a receiving member receptacle having a first reference surface;

a receiving member having a second reference surface, said receiving member defining at least one recess for receiving said second die assembly therein, said recess being a first predetermined distance from said second reference surface, and said receiving member being carried in said receptacle; and at least one spacer of a predetermined thickness being interposed in said receptacle between said first and second reference surfaces for causing said second die assembly carried in said receiving member to be in an elevationally aligned with respect to said first die assembly.

4. A press machine as defined in claim 3, wherein said piston means includes:

a primary piston member having a first end and a second end, said first end being connected to said crankshaft, and said second end defining a first cooperating interface; and a secondary piston member having a forward end and a rearward end, said rearward end defining a second cooperating interface for interconnecting with said first cooperating interface of said primary piston member, thereby substantially fixing said secondary piston member for movement with respect to said primary piston member; said forward end of said secondary piston member defining a spider recess and a punch recess adjacent to said spider recess.

5. A press machine as defined in claim 4, further comprising said secondary piston member defining a centrally located, longitudinally extending, spider shank passage.

6. A press machine as defined in claim 4, further comprising a die retainer attached to said forward end of said secondary piston member, adjacent to said punch recess.

7. A press machine as defined in claim 4, further comprising said secondary piston member defining a longitudinally extending groove; and a projection provided in said longitudinally extending bore of said cylinder for engaging said longitudinally extending groove of said secondary piston member.

8. A press machine as defined in claim 4, wherein said first cooperating interface includes a substantially cylindrical portion projecting outwardly from said second end of said primary piston member, and wherein said second cooperating interface includes said rearward end of said secondary piston member defining a substantially cylindrical recess for receiving said substantially cylindrical portion of said primary piston member.

9. A press machine as defined in claim 3, further comprising:

lubricating means associated with said frame for supplying lubricating fluid to said cylinder, said piston means, and said crankshaft; and lubricating fluid recovery means associated with said frame for collecting lubricating fluid emitted from said cylinder, said piston means, and said crankshaft during operation of the press machine.

10. A press machine as defined in claim 9, wherein said lubricating fluid recovery means includes:

an outwardly extending collection surface projecting outwardly from said cylinder, said piston means, and said crankshaft;

said outwardly extending collection surface defining at least one collection channel therein, said collection surface being in fluid communication with said collection channel;

said collection channel defining a drain;

said collection channel being in fluid communication with said drain, such that upon emission of lubricating fluid, the lubricating fluid collects on said collection surface and said collection channel and flows to said drain;

filter means in fluid communication with said drain for receiving the lubricating fluid therefrom and for filtering lubricating fluid received from said drain; and pumping means in fluid communication with both said filter means and said lubricating means for pumping lubricating fluid filtered by said filter means to said lubricating means for re-use by said lubricating means.

11. A press machine as defined in claim 8, wherein said outwardly extending collection surface is inclined toward said collection channel for allowing drainage from said collection surface to said collection channel.

12. A press machine as defined in claim 1, further comprising:

air supply means connected to said first die assembly for delivering air to said first die assembly;

valving means connected to said air supply means for controlling said air supply means to selectively supply air to said first die assembly;

cam means demountably attached to said crankshaft for rotation with said crankshaft, said cam means defining a predetermined cam profile surface thereon; and cam follower means connected to said valving means, said cam follower means contacting said cam profile surface of said cam means during rotation of said crankshaft and being displaceable by said cam means such that upon rotation of said crankshaft, said cam follower means are displaced in a predetermined manner through contact with said cam profile surface to actuate said valving means, whereupon said valving means supplies air to said first die assembly.

13. A press machine as defined in claim 12, wherein said cam follower means includes a roller for contacting said cam profile surface.

14. A method of aligning the elevations of a first die assembly and a second die assembly of a press, comprising the steps of:

providing a press frame having a first die assembly at a predetermined alignment elevation connected to a piston, said press defining a receptacle proximate to said first die assembly and a first reference surface in said receptacle;

providing a receiving member having a second reference surface and defining at least one recess for receiving said second die assembly, said recess being a predetermined distance from said second reference surface;

inserting at least one spacer of a predetermined thickness in said receptacle of said press frame for contact with said first and second reference surfaces, such that upon placement of said receiving member in said receptacle on said at least one spacer and upon placing said second die assembly in said receiving member, said second die assembly is at said predetermined alignment elevation and is in substantial elevational alignment with said first die assembly;

placing said receiving member in said receptacle upon at least one said spacer; and placing said second die assembly in said recess of said receiving member such that said second die assembly is in substantial elevational alignment with said first die assembly.

15. A press machine, comprising:

a frame;

a motor attached to said frame;

a crankshaft rotatably carried by said frame and connected to said motor for rotation by said motor;

a cylinder carried by said frame, said cylinder defining a longitudinally extending bore therein;

piston means carried for movement within said bore of said cylinder, said piston means being connected to said crankshaft for rectilinear movement within said bore of said cylinder upon rotation of said crankshaft, said piston means including:

a primary piston member having a first end and a second end, said first end being connected to said crankshaft, and said second end defining a first cooperating interface;

a secondary piston member having a forward end and a rearward end, said rearward end defining a second cooperating interface for interconnecting with said first cooperating interface of said primary piston member, thereby substantially fixing said secondary piston member for movement with respect to said primary piston member; said forward end of said secondary piston member defining a spider recess and a punch recess adjacent to said spider recess;

a first die assembly connected to said piston means for movement with said piston means;

a second die assembly adjacent to said first die assembly and connected to said frame;

stock supply means associated with said frame for supplying stock to said first and second die assemblies for stamping of the stock therebetween;

air supply means connected to said first die assembly for delivering air to said first die assembly;

valving means connected to said air supply means for controlling said air supply means to selectively supply air to said first die assembly;

cam means demountably attached to said crankshaft for rotation with said crankshaft, said cam means defining a predetermined cam profile surface thereon;

cam follower means connected to said valving means, said cam follower means contacting said cam profile surface of said cam means during rotation of said crankshaft and being displaceable by said cam means such that upon rotation of said crankshaft, said cam followers are displaced in a predetermined manner through contact with said cam profile surface to actuate said valving means, whereupon said valving means supplies air to said first die assembly;

lubricating means connected to said cylinder, said piston means, and said crankshaft, for supplying lubricant thereto;

lubricating fluid recovery means associated with said frame for collecting lubricating fluid emitted from said cylinder, said piston means, and said crankshaft during operation of the press machine;

said frame defining a receiving member receptacle having a first reference surface;

a receiving member having a second reference surface, said receiving member defining at least one recess for receiving said second die assembly therein, said recess being a first predetermined distance from said second reference surface, said receiving member being carried in said receptacle; and at least one spacer of a predetermined thickness being interposed in said receptacle between said first and second reference surfaces for causing said second die assembly carried in said receiving member to be in elevational alignment with respect to said first die assembly.

16. A drive assembly connectable to a crankshaft of a press, comprising:

a cylinder member defining a longitudinally extending bore therein;

a primary piston member carried for substantially rectilinear movement within said bore, said primary piston member having a first end and a second end, said first end being connectable to said crankshaft and said second end defining a first cooperating interface; and a secondary piston member carried for substantially rectilinear movement within said bore, said secondary piston member having a forward end and a rearward end, said rearward end defining a second cooperating interface for interconnecting with said first cooperating interface of said primary piston member, thereby substantially fixing together said primary piston member and said secondary piston member; said forward end of said secondary piston member defining a spider recess and a punch recess adjacent to said spider recess.

17. A drive assembly as defined in claim 14, further comprising said secondary piston member defining a centrally located, longitudinally extending spider shank passage.

18. A drive assembly as defined in claim 16, further comprising a die retainer attached to said forward end of said secondary piston member, adjacent to said punch recess.

19. A drive assembly as defined in claim 16, further comprising said secondary piston member defining a longitudinally extending groove; and a projection provided in said longitudinally extending bore of said cylinder for engaging said longitudinally extending groove of said secondary piston member.

20. A drive assembly as defined in claim 16, wherein said first cooperating interface includes a substantially cylindrical portion projecting outwardly from said second end of said primary piston member, and wherein said second cooperating interface includes said rearward end of said second piston member defining a substantially cylindrical recess for receiving said substantially cylindrical portion of said primary piston member.

* * * * *

UNITED STATES PATENT AND TRADEMARK OFFICE

CERTIFICATE OF CORRECTION

PATENT NO. : 5,259,225

DATED : November 9, 1993

INVENTOR(S) : Eugene P. Koch

It is certified that error appears in the above-indentified patent and that said Letters Patent is hereby corrected as shown below:

Column 11, line 25, delete —,— between "stock" and "supply".

Column 11, line 41, delete "in an".

Column 12, line 46, delete "8" and insert —10— therefor.

Column 12, line 50, delete "1" and insert —3— therefor.

Column 14, line 63, delete "14" and insert —16— therefor.

Signed and Sealed this

First Day of November, 1994

Bruce Lehman

*Attest:*

BRUCE LEHMAN

*Attesting Officer*

*Commissioner of Patents and Trademarks*